US006125769A

United States Patent [19]

Tsai et al.

[11] Patent Number: 6,125,769

[45] Date of Patent: Oct. 3, 2000

[54] FOLDING TABLE

[76] Inventors: Ting-sheng Tsai, No. 14, Alley 1, Lane 110, Da-Yung St., Kang Shan Chen, Kaohsiung Hsien, Taiwan; Wei-sin Chang, 1416 Tohnson Ave., Santa Clara, Calif. 95129

[21] Appl. No.: 09/366,770

[22] Filed: Aug. 4, 1999

[51] Int. Cl.[7] ..... A47B 3/00

[52] U.S. Cl. ..... 108/34; 108/118; 108/67; 297/16.2; 248/166

[58] Field of Search ..... 108/34, 35, 38, 108/67, 115, 118; 248/166, 168, 170, 279.1; 297/16.2

[56] References Cited

U.S. PATENT DOCUMENTS

| | | | |
|---|---|---|---|
| 487,200 | 11/1892 | Smith . | |
| 1,135,864 | 4/1915 | Tomassi | 108/34 |
| 1,717,908 | 6/1929 | Antonuk | 248/170 |
| 3,635,520 | 1/1972 | Roher et al. | 108/118 X |
| 4,073,484 | 2/1978 | Beekenkamp | 108/118 X |
| 5,421,273 | 6/1995 | Lin | 108/34 X |
| 5,709,428 | 1/1998 | Hugghins | 297/16.2 |
| 5,884,566 | 3/1999 | Chen | 108/67 |

FOREIGN PATENT DOCUMENTS

| | | | |
|---|---|---|---|
| 559120 | 9/1923 | France | 108/34 |
| 643051 | 9/1928 | France | 108/38 |
| 578523 | 6/1958 | Italy | 108/34 |
| 197414 | 5/1923 | United Kingdom | 108/35 |

*Primary Examiner*—Peter M. Cuomo
*Assistant Examiner*—Hanh V. Tran
*Attorney, Agent, or Firm*—Rosenberg, Klein & Lee

[57] ABSTRACT

A folding table comprises a foldable table surface and a support frame. The table surface is formed with six pieces of wood boards and four clamps. The wood boards, or strips, are coupled one to the other, and the table surface is formed with clamps. The foot support includes a connecting device, four upper legs, four lower legs, four angle connectors and two rods. Wherein, the connecting device is a frame with four parallel boards, each board is connected to an upper leg and a lower leg, respectively. Each upper leg is connected to an angle connector and every two angle connectors are secured to a rod, thus, the table surface is secured to the rods and assembled with the legs.

20 Claims, 6 Drawing Sheets

FOLDING TABLE

BACKGROUND OF THE INVENTION

1. Field of the Invention

This invention relates to the structure of a folding table, and more particularly, to a table surface and a foot support in a foldable condition, the table surface is foldable like a barrel and stored with the foot support.

2. Prior Art

The conventional foldable tables are mostly including a harden material surface with a pair of connecting foldable support. This design is inconvenient in outdoor carrying. The other kind of foldable table has no such disadvantage, it uses cloth as its table surface and chair back. However the strength of the cloth is not as strong as the harden surface. In view of this, the inventor has invented the present invention which improves the previous shortcoming.

SUMMARY OF THE INVENTION

It is the primary object of the present invention to provide a folding table and a foot support which is easy to assemble and is compact for storage and carry.

It is another object of the present invention to provide a folding table and a foot support which uses less components and is cost effectiveness.

DETAILED DESCRIPTION OF THE PREFERRED EMBODIMENT

Figure 1:
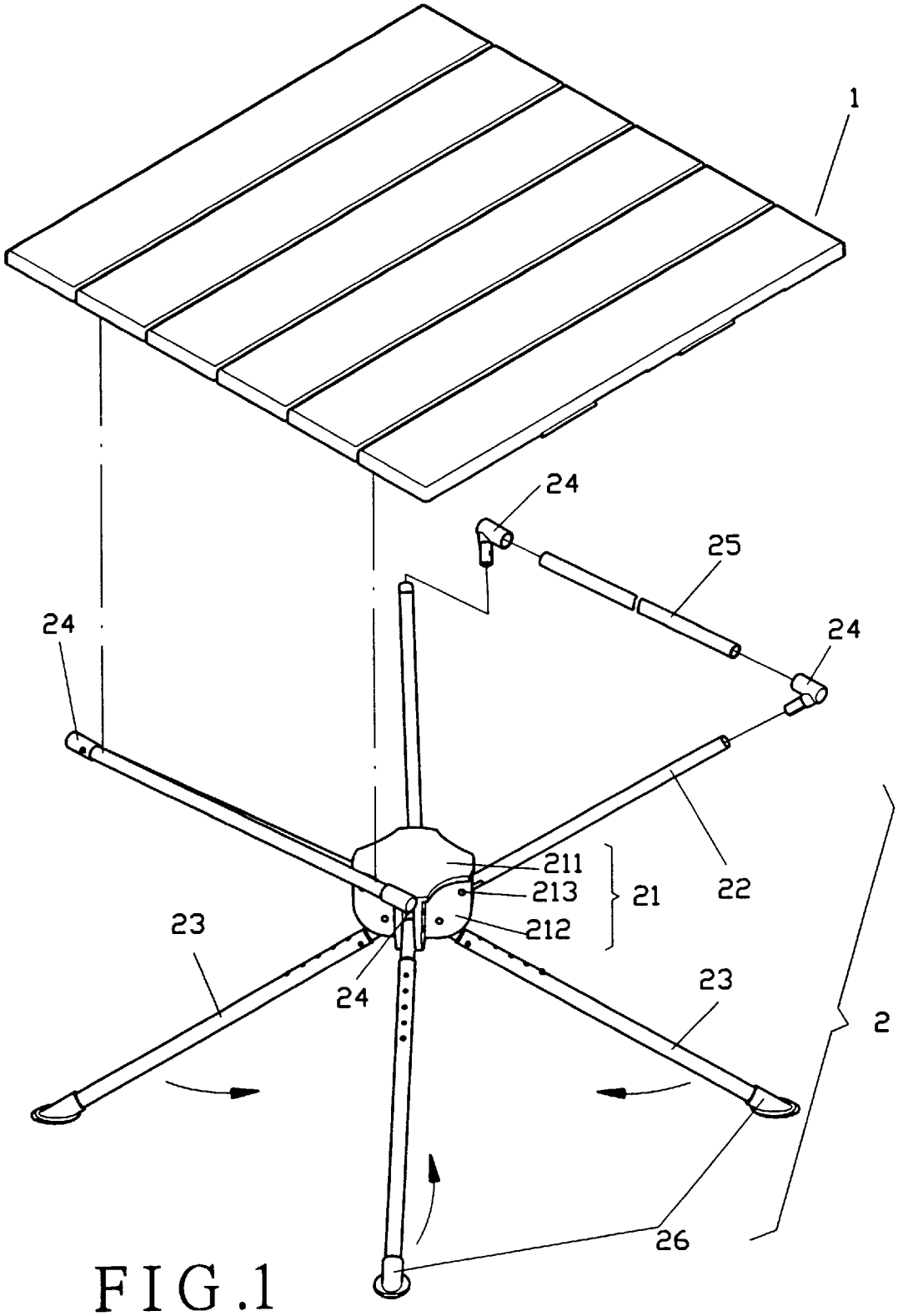
FIG. 1 is an exploded view of the present invention.
Figure 3:
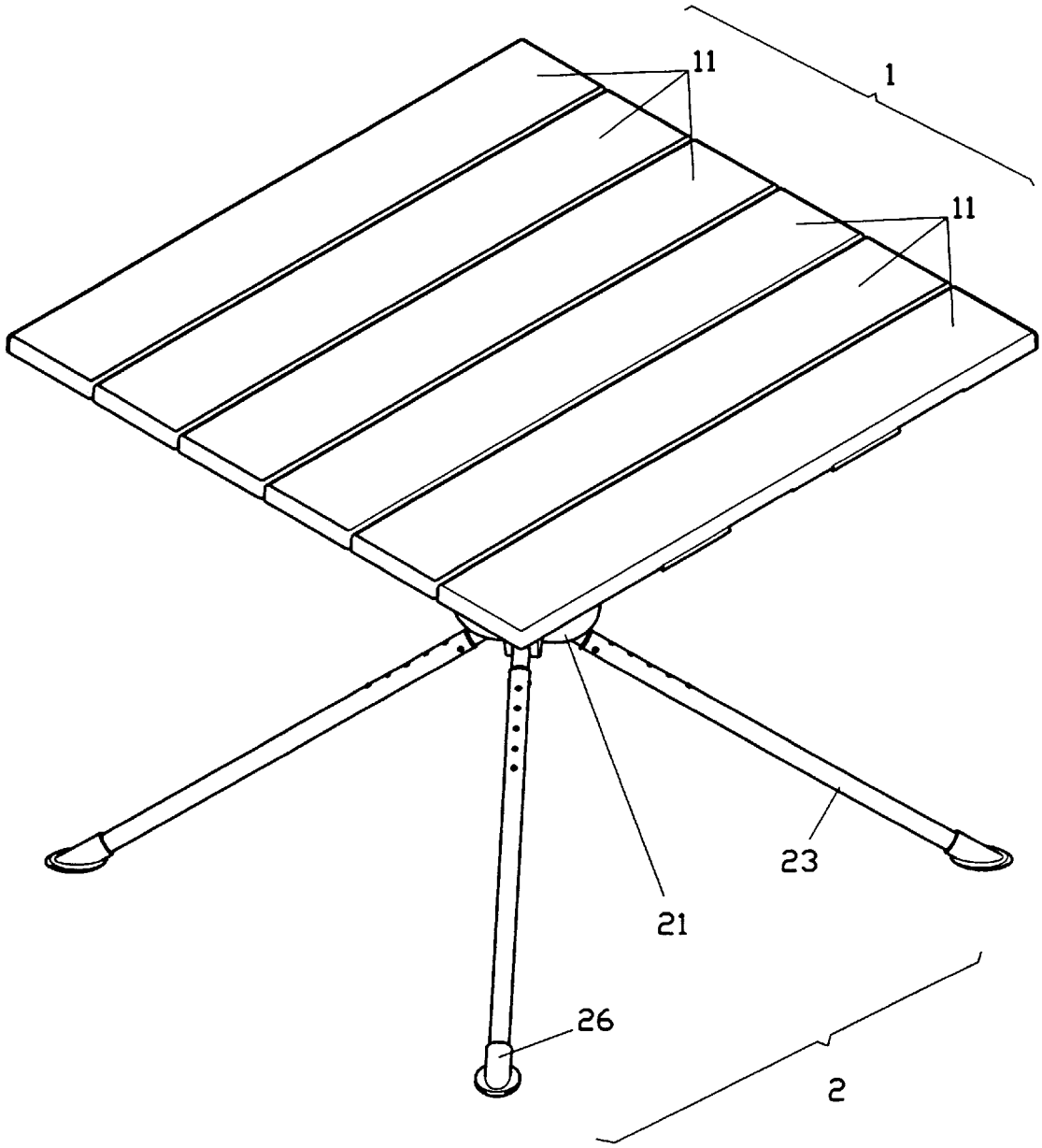
FIG. 3 is a perspective view of the present invention.

The present invention as shown in FIG. 1 and FIG. 3, is generally composed of a table surface 1 and a foot support 2.

Figure 2:
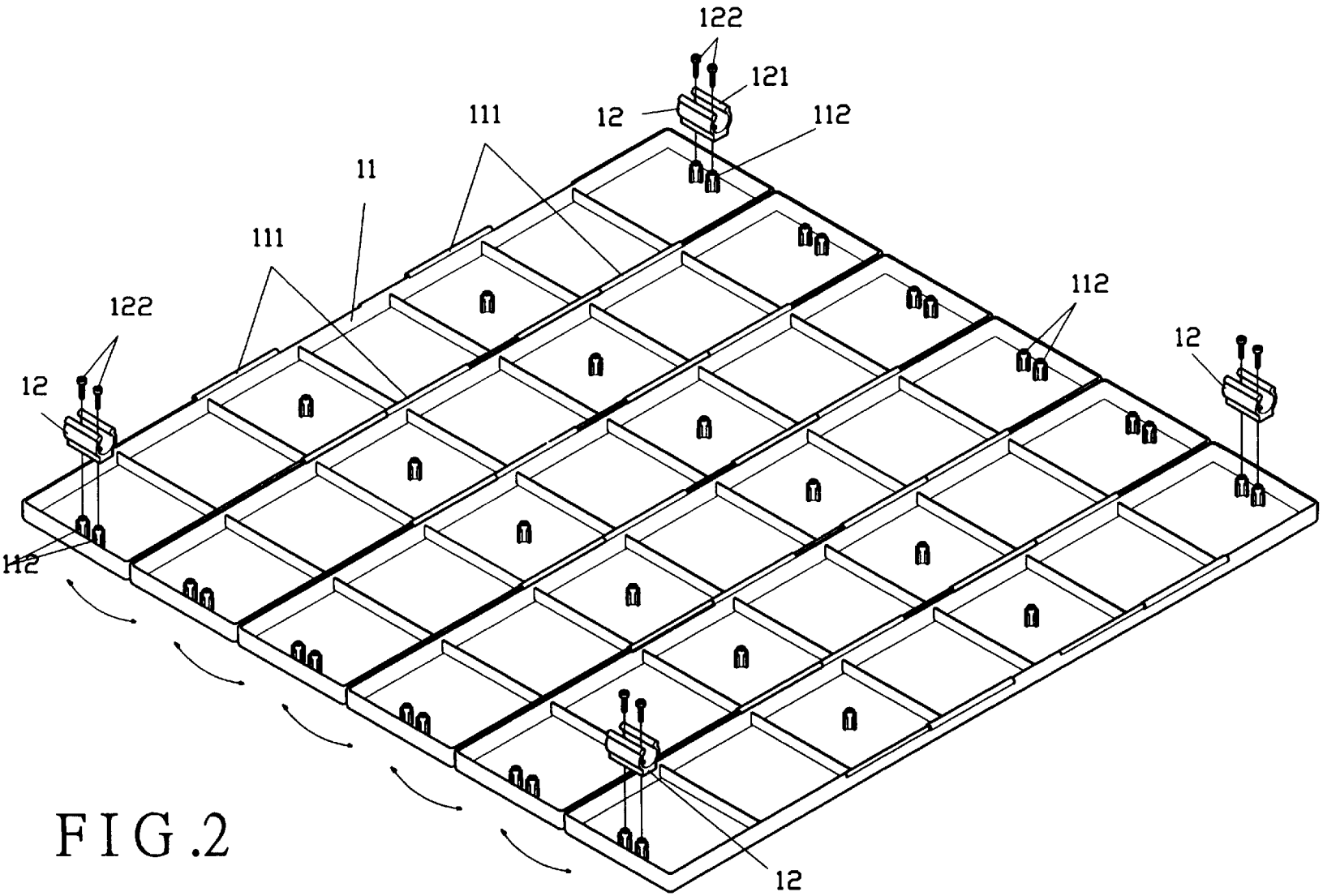
FIG. 2 is an exploded view of a table surface of the present invention.

The table surface 1, as shown in FIG. 2, (which displays the table surface 1 in an upside down manner), is formed by six pieces of strips 11 and four clamps 12. Each of the strips 11 is formed in a long body with hinge tubes 111 extending from the bottom of both ends, the inner portions of both ends are formed with bosses 112. The strips 11 next to each other are pinned together, the endmost of the strip 11 is engaged with its boss 112 to the clamp 12. The clamp 12 has a clip 121 which is secured to the boss 112 by bolts 122.

Figure 4:
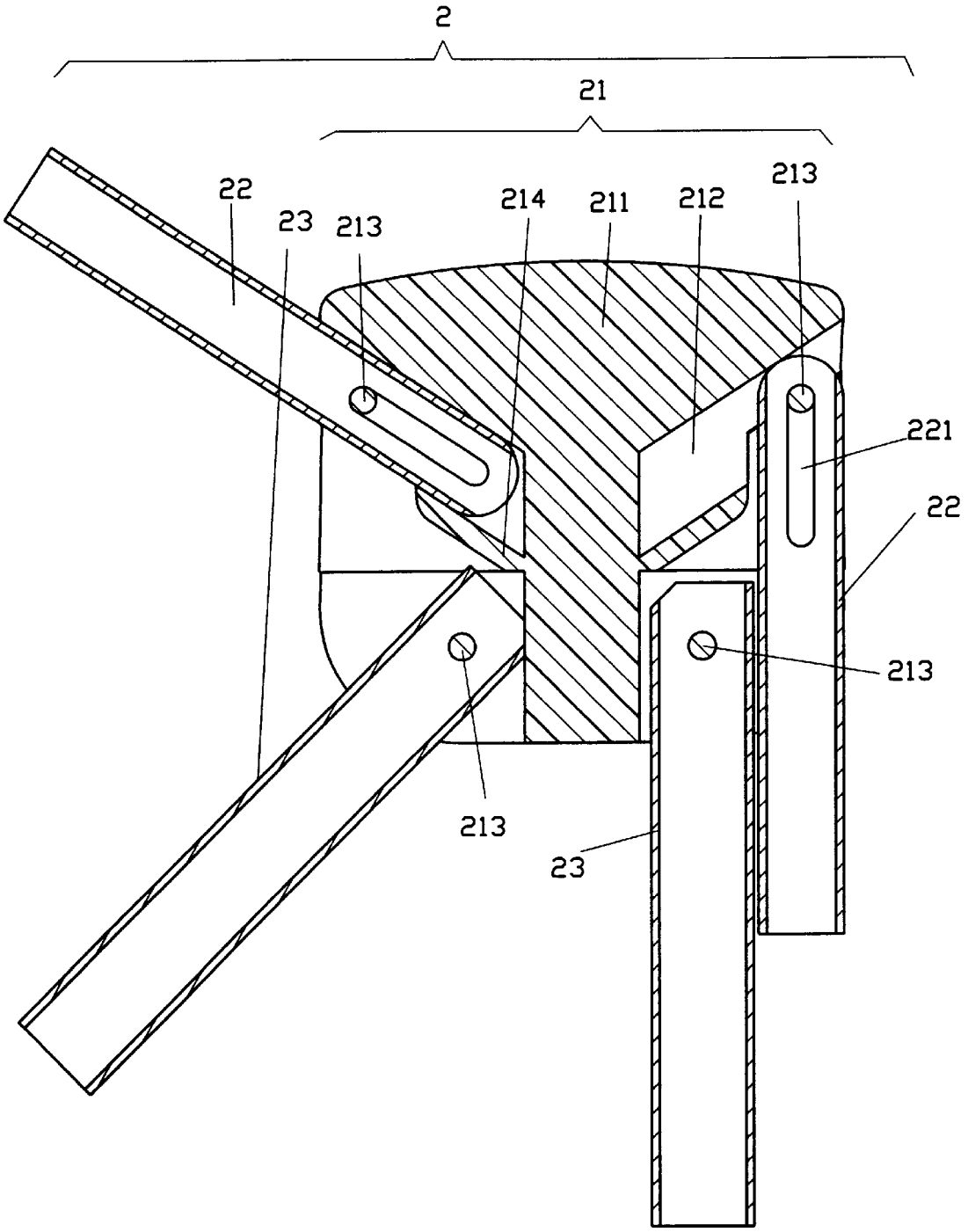
FIG. 4 is an enlarged view of a foot support of the present invention.

The foot support 2, as shown in FIG. 4, comprises a connecting device 21, four upper legs 22, four lower legs 23, four angle connectors 24, two rods 25 and four pads 26. The upper leg 22 is formed with a slot 221 at the lower section, the connecting device 21 is four parallel boards 212 extending downwardly from a piece of flat board 211. Each parallel board 212 has a pair of holes at the upper and the lower portions for a rivet 213 to insert there through and secured to the slot 221 of the upper leg 22 and the top portion of the lower leg 23. When the upper and the lower legs 22 and 23 are in an open status, the slot 221 will slide along the rail of the rivet 213 until it has reached to a stopper 214. One end of each lower leg 23 is attached with a pad 26, and the upper legs 22 are open upwardly with its upper end connected to angle connectors 24 which then connected to the rods 25.

In this manner, the two ends strips 11 of the table surface 1 are connected with the clamp 12 at bottom portion to the rods 25 and the foot support 2, as shown in FIG. 3.

Figure 5:
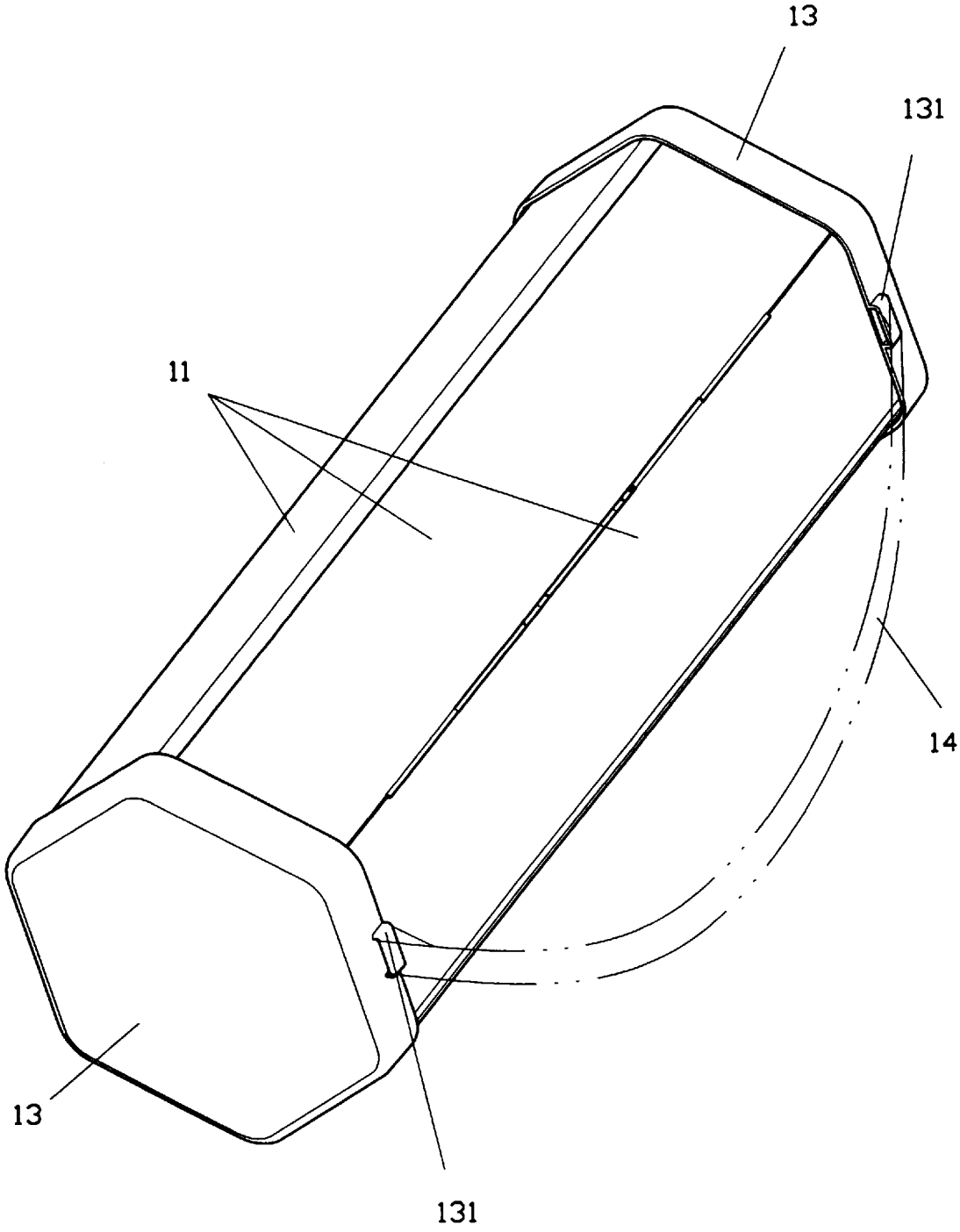
FIG. 5 is a perspective view of the present invention in a foldable status.

To collapse, disassemble the clamp 12 of the table surface 1 and the foot support 2, spin the strips 11 of the table surface 1 and fold into a hexagon shape, and then pull the upper legs 22 to bring the lower end detached from the stopper 214. Thus, the upper legs 22 and the lower legs 23 are loosen to form a bundle which at this moment may be placed within the hexagon shaped table surface 1, as shown in FIG. 4. Cap the two ends of the hexagon table surface 1 with covers 13, as shown in FIG. 5, and then string a belt 14 into rings 131 of the covers 13 to form a carrying belt.

Figure 6:
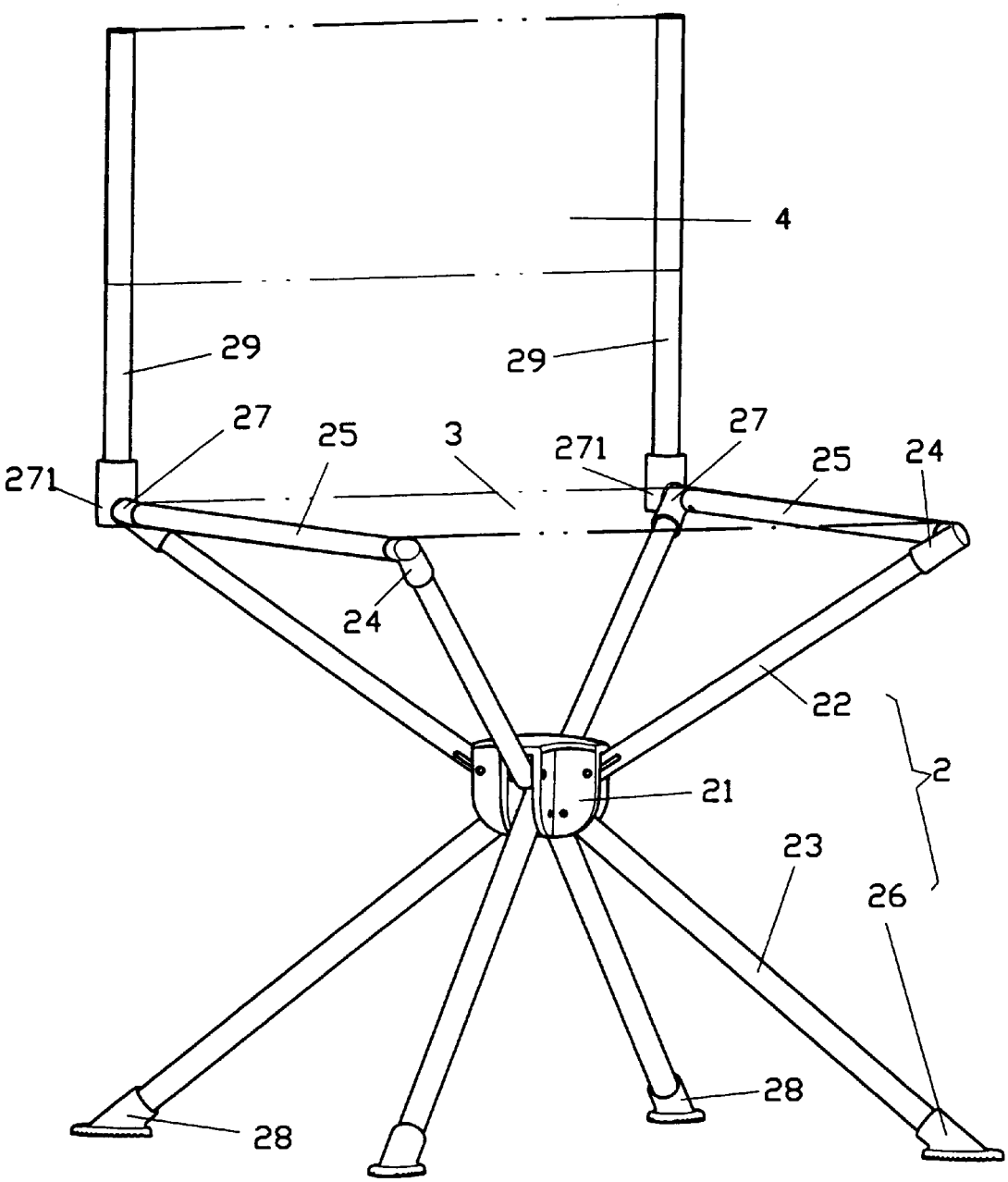
FIG. 6 is a perspective view of a chair of the present invention.

The present invention is able to change to a chair, as shown in FIG. 6, which shows a pair of angle connectors 24 of the chair support 2 may be replaced with a pair of connectors 27, and two of the lower legs 23 corresponding to the connectors 27 are sleeved with pads 28. The seat back supports 29 are inserted into the connectors 27 and the connecting ring 271. The chair seat 3 are still sleeved to the rods 25, wherein the seat back 4 is formed with a soft cloth.

From the FIGS. 1 and 6, the present invention uses many components identical or even exchangeable with each other, thus the cost is relatively inexpensive.

What is claimed is:

1. A collapsible table system comprising:

(a) a table surface assembly including:

(1) at least six longitudinally extended strips each having opposed top and bottom sides, adjacent ones of said strips being coupled one to the other; and, (2) at least four clamps each coupled to a bottom side of one said strip adjacent a peripheral portion thereof; and, (b) a collapsible foot support assembly releasably coupled to said table surface assembly, said foot support assembly including:

(1) a connecting device having a flat board portion and at least four parallel board portions extending transversely therefrom;

(2) at least four upper legs each having distal upper and lower ends, said lower end of each said upper leg being coupled to one said parallel board portion;

(3) at least four lower legs each having distal upper and lower ends, said upper end of each said lower leg being coupled to one said parallel board portion;

(4) at least a pair of rods; and, (5) at least four angle connectors each connecting one said upper leg to one said rod.

2. The collapsible table system as recited in claim 1 wherein each said strip is hingedly connected to at least one of the other said strips.

3. The collapsible table system as recited in claim 2 wherein each of said strips includes a plurality of boss portions extending from said bottom side thereof, at least a pair of said boss portions supporting each said clamp of said table surface assembly.

4. The collapsible table system as recited in claim 1 wherein each said clamp of said table surface assembly is releasably coupled to one said rod of said foot support assembly.

5. The collapsible table system as recited in claim 1 wherein each said parallel board portion of said connecting device includes a pair of substantially planar members spaced one from the other in opposed manner, each said member having formed therein first and second holes, said first holes of said members being substantially aligned one with the other, said second holes of said members being substantially aligned one with the other.

6. The collapsible table system as recited in claim 5 wherein said lower end of each said upper leg is pivotally disposed between said spaced members of one said parallel board portion adjacent said first holes thereof, and said upper end of each said lower leg is pivotally disposed between said spaced members of one said parallel board portion adjacent said second holes thereof.

7. The collapsible table system as recited in claim 6 wherein said connecting device further includes a plurality of rivet members pivotally coupling said lower and upper legs to said parallel board portions of said connecting device, one said rivet member engaging each aligned pair of said first and second holes.

8. The collapsible table system as recited in claim 7 wherein said lower end of each said upper leg has formed therein a slot for slidably receiving one said rivet member, whereby each said upper leg is pivotally and linearly displaceable for adjustment between extended and collapsed positions.

9. The collapsible table system as recited in claim 8 wherein said connecting device further includes a plurality of stopper portions for supporting said lower leg in said extended position thereof.

10. The collapsible table system as recited in claim 1 wherein said table surface assembly is collapsible upon decoupling from said foot support assembly to a hollow folded configuration having a hexagonal sectional contour, said table assembly in said folded configuration being adapted to receive therein said foot support assembly in a collapsed configuration.

11. The collapsible table system as recited in claim 10 further comprising a pair of hexagonal end covers for enclosing a pair of hexagonal ends of said support assembly in said hollow folded configuration.

12. The collapsible table system as recited in claim 1 wherein at least a pair of said angle connectors each have formed thereon a supplemental connecting ring.

13. The collapsible table system as recited in claim 12 further comprising a pair of back supports each engaging one said supplemental connecting ring, said back supports supporting a chair back member extending therebetween.

14. A collapsible table assembly comprising:

(a) a table surface assembly including:

(1) a plurality of longitudinally extended strips each having opposed top and bottom sides, adjacent ones of said strips being coupled one to the other; and, (2) a plurality of clamps each coupled to a bottom side of one said strip adjacent a peripheral portion thereof; and, (b) a collapsible foot support assembly releasably coupled to said table surface assembly, said foot support assembly including:

(1) a connecting device having a flat board portion and a plurality of parallel board portions extending transversely therefrom;

(2) a plurality of upper legs each having distal upper and lower ends, said lower end of each said upper leg being coupled to one said parallel board portion;

(3) a plurality of lower legs each having distal upper and lower ends, said upper end of each said lower leg being coupled to one said parallel board portion;

(4) at least a pair of rods; and, (5) a plurality of angle connectors each connecting one said upper leg to one said rod.

15. The collapsible table system as recited in claim 14 wherein each said strip is hingedly connected to at least one of the other said strips.

16. The collapsible table system as recited in claim 15 wherein each of said strips includes a plurality of boss portions extending from said bottom side thereof, at least a pair of said boss portions supporting each said clamp of said table surface assembly.

17. The collapsible table system as recited in claim 14 wherein each said clamp of said table surface assembly is releasably coupled to one said rod of said foot support assembly.

18. The collapsible table system as recited in claim 14 wherein each said parallel board portion of said connecting device includes a pair of substantially planar members spaced one from the other in opposed manner, each said member having formed therein first and second holes, said first holes of said members being substantially aligned one with the other, said second holes of said members being substantially aligned one with the other.

19. The collapsible table system as recited in claim 18 wherein said lower end of each said upper leg is pivotally disposed between said spaced members of one said parallel board portion adjacent said first holes thereof, and said upper end of each said lower leg is pivotally disposed between said spaced members of one said parallel board portion adjacent said second holes thereof.

20. The collapsible table system as recited in claim 14 wherein said table surface assembly is collapsible upon decoupling from said foot support assembly to a hollow folded configuration having a polygonal sectional contour, said table assembly in said folded configuration being adapted to receive therein said foot support assembly in a collapsed configuration.

* * * * *